US006287512B1

(12) United States Patent
Stamma et al.

(10) Patent No.: US 6,287,512 B1
(45) Date of Patent: Sep. 11, 2001

(54) FRAME FOR A BLAST FURNACE

(75) Inventors: Franz Stamma; Martin Fobbe, both of Bochum (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/315,683

(22) Filed: May 20, 1999

(30) Foreign Application Priority Data

May 25, 1998 (DE) ..... 198 22 984

(51) Int. Cl.[7] ..... C21B 13/06
(52) U.S. Cl. ..... 266/142; 266/198
(58) Field of Search ..... 266/142, 197, 266/198, 287

(56) References Cited

U.S. PATENT DOCUMENTS 3,431,691 * 3/1969 Greaves et al. ..... 266/198
3,559,972 * 2/1971 Greaves ..... 266/198

* cited by examiner

*Primary Examiner*—Scott Kastler
(74) *Attorney, Agent, or Firm*—Friedrich Kueffner

(57) ABSTRACT

A frame for supporting structural components of a blast furnace includes a bottom section connected to a foundation, a middle section and a top structure arranged above the furnace top, wherein the frame is manufactured as a lattice-work construction and/or framework construction and extends in four planes. The bottom section of the frame is provided in the four planes thereof with support members which extend toward each other and meet each other in a base point.

10 Claims, 2 Drawing Sheets

A - A

FRAME FOR A BLAST FURNACE

BACKGROUND OF THE INVENTION

1. Field of the Invention

The present invention relates to a frame for supporting structural components of a blast furnace. The frame is composed of a bottom section connected to a foundation, a middle section and a top structure arranged above the furnace top, wherein the frame is manufactured as a lattice-work construction and/or framework construction and extends in four planes.

2. Description of the Related Art

Blast furnace frames of the above-described type serve to support own weight loads, traffic loads and crane loads and to hold structural components of the blast furnace, such as, the hot air distribution pipe and the gas discharge pipes. The steel structure of the frame is composed of a bottom section, a middle section and a top structure arranged above the furnace top. The loads are introduced into the foundation through the corner posts of the bottom section of the frame.

The dimensions of the bottom section of the frame depend on the location of the pool channels, the work areas of the blast furnace guns and the drilling machines, the diameter of the hot distribution pipe as well as any necessary travel areas.

External influences, such as wind loads or earthquakes, lead to relative movements between the furnace armor and the frame. Even though the frame has a very high weight, earthquakes may cause significant structural components, such as the gas discharge pipes or the hot air distribution pipe, to be torn off.

SUMMARY OF THE INVENTION

Therefore, starting from the prior art discussed above, it is the primary object of the present invention to propose a frame for a blast furnace which has a lighter weight and, thus, is more economical while providing a comparable load bearing capacity, wherein the frame provides an improved security with respect to external influences which may lead to relative movements between the furnace armor and the frame.

In accordance with the present invention, in a frame of the above-described type, this object is met by providing the bottom section of the frame in the four planes thereof with support members which extend toward each other and meet each other in a base point.

It has been found that the support members arranged in this V-shaped configuration lead to smaller relative movements between the frame and the furnace armor than is the case in frames with conventional corner posts of the bottom section of the frame. The smaller relative movements make possible a less expensive construction of the transition from the structural components to the frame. Finally, the V-shaped configuration of the support members make possible a more economical dimensioning of the frame.

If these frames are stiffened by horizontal and diagonal girders, the frame rests on four flat triangular discs which rest with the tips thereof in the base points.

An even lighter and, thus, more economical embodiment of the frame becomes possible if the bottom section and/or the middle section of the frame are structurally connected to the furnace armor. In that case, the furnace armor absorbs the horizontal loads acting on the frame. For example, the connection can be provided between the middle section of the frame and the furnace armor underneath the charging platform. As a result of this measure, the relative movement between the frame and the furnace armor is even further reduced. This results in a significantly improved safety in the case of an earthquake.

In order to ensure a uniform load introduction from the frame into the furnace armor, particularly in the case of an earthquake, an advantageous further development of the invention provides that coupling members are arranged in a horizontal plane and uniformly distributed over the circumference of the furnace armor.

However, the coupling members between the frame and the furnace armor are not only significant features in areas in which earthquakes may occur, rather, the coupling members facilitate smaller total dimensions of the frame and, thus, a more economical construction.

In order to further reduce the danger that the hot air distribution pipe tears off from the furnace, another development of the present invention provides that one or more of the structural components of the blast furnace, particularly the hot air distribution pipe, are connected to the frame.

Based on the finding that in the case of an earthquake a hot air distribution pipe has the behavior of a pendulum, it may be provided that the hot air distribution pipe is suspended from connecting rods in the frame and is held horizontally in the frame by coupling means.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
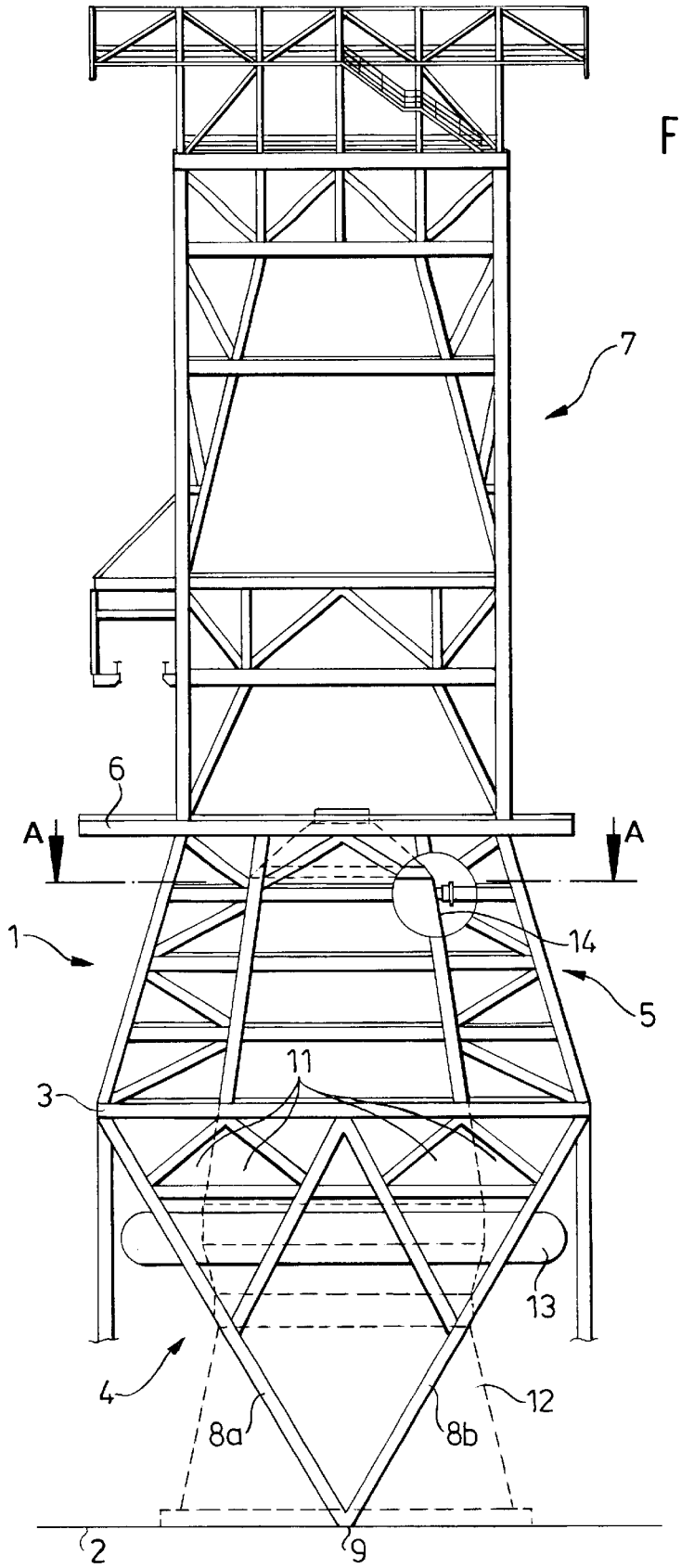
FIG. 1 is a side view of a frame for a blast furnace according to the present invention.

A frame 1 shown in FIG. 1 of the drawing is composed of a bottom section 4 extending between a foundation 2 and a platform 3, a middle section 5 connected to the bottom section 4, wherein a charging platform 6 forms the upper end of the middle section 5. Mounted above the charging platform 6 is a top structure 7 which forms the upper end of the frame 1.

Figure 2:
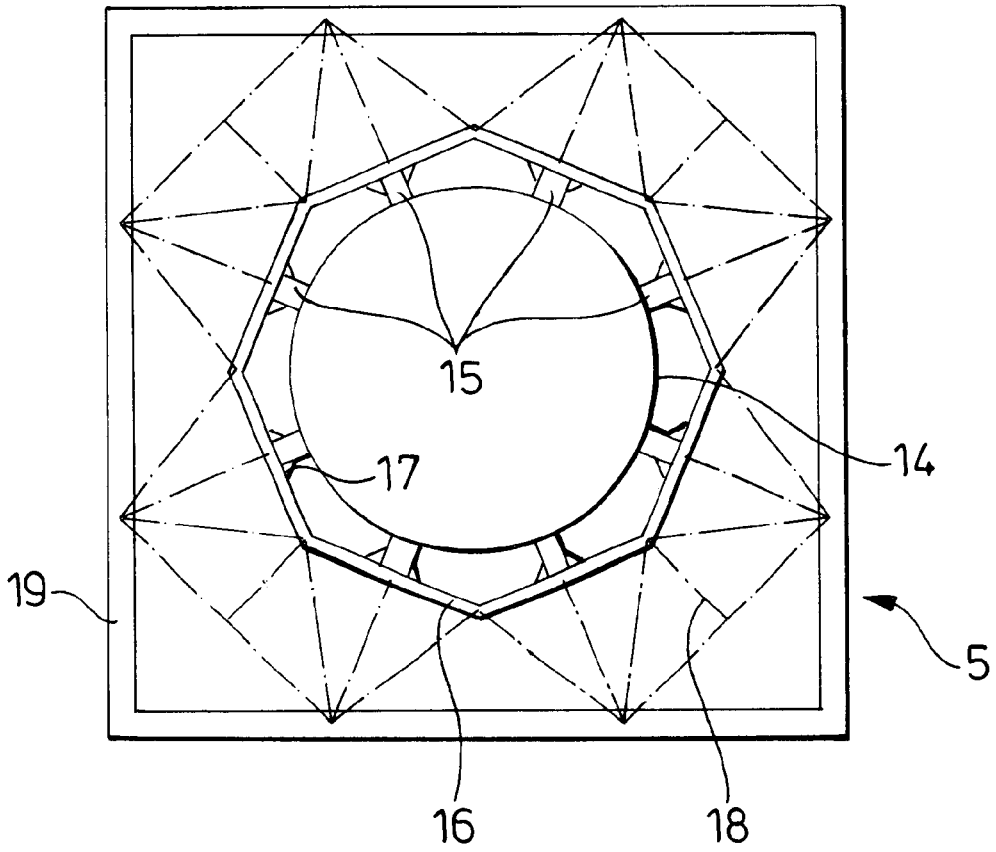
FIG. 2 is a sectional view taken along sectional line A—A of FIG. 1.

As can be seen particularly in FIG. 2, the middle section 5 as well as the bottom section 4 and the top structure 7 are defined on all sides by four planes, wherein the side view of FIG. 1 shows one of the planes. The bottom section 4 of the frame constructed as a framework structure is on its sides defined by parts of support members 8*a*, 8*b* in each of the first places which extend toward each other and meet in a base point 9 at the foundation 2. Additional girders 11 for stiffening the framework are provided between the lateral support members 8*a*, 8*b*.

The frame 1 surrounds a blast furnace 12, shown in broken lines, including its hot air distribution pipe 13.

In the middle section of the frame on the level of the line A—A, the blast furnace 12 is connected through coupling elements 15 to the middle section 5 of the frame. As can be seen in FIG. 2, a total of eight such coupling elements 15 are arranged in a horizontal plane over the circumference of the furnace armor 14. On the side of the frame, the coupling elements 15 are held by an octagonal frame 16 with receiving means 17. The frame 16, in turn, is supported by a horizontal framework 18 at outer support members 19 of the middle section 5 of the frame.

The support members 8*a*, 8*b* which extend toward each other and meet in a common base point 9 as well as the structural connection of the furnace armor 14 to the middle section 5 of the furnace make it possible, as compared to conventional frames having the same load bearing capacity, to provide a more economical configuration of the steel structure of the frame, particularly because of the lighter weight. Simultaneously, horizontal movements between the frame and the blast furnace are effectively reduced. This makes it possible to provide structurally simpler transitions, for example, from the hot air distribution pipe 13 to the furnace 12. In addition, the danger of tearing off of structural components, for example, due to earthquakes, is significantly reduced.

While specific embodiments of the invention have been shown and described in detail to illustrate the inventive principles, it will be understood that the invention may be embodied otherwise without departing from such principles.

We claim:

1. A frame for supporting structural components of a blast furnace, the frame comprising a bottom section connected to a foundation, a middle section connected to the bottom section, and a top structure mounted above a furnace top, wherein the frame is constructed as framework construction and/or lattice work construction and extends in four planes, wherein the bottom section comprises pairs of support members extending in each of the four planes of the bottom section, wherein the support members of each pair of support members extend toward each other and meet in a single base point at the foundation.

2. The frame according to claim 1, wherein the support members extending toward each other define the four planes of the bottom section of the frame.

3. The frame according to claim 1, further comprising stiffening elements between the support members.

4. The frame according to claim 1, wherein at least one of the bottom section and the middle section is connected to a furnace armor.

5. The frame according to claim 4, wherein at least one of the bottom section and the middle section is connected in at least one horizontal plane through several coupling means to the furnace armor.

6. The frame according to claim 5, wherein the coupling means have an adjustable length.

7. The frame according to claim 5, wherein coupling means are provided in each horizontal plane.

8. The frame according to claim 1, wherein a structural component of the blast furnace is connected to a furnace armor.

9. The frame according to claim 8, wherein the structural components is a hot air distribution pipe.

10. The frame according to claim 9, wherein the hot air distribution pipe is suspended from connecting rods at the frame and is secured horizontally in the frame.

* * * * *